US009127408B2

(12) United States Patent
Qin et al.

(10) Patent No.: US 9,127,408 B2
(45) Date of Patent: Sep. 8, 2015

(54) TISSUE HAVING REDUCED HYDROGEN BONDING

(71) Applicant: Kimberly-Clark Worldwide, Inc., Neenah, WI (US)

(72) Inventors: Jian Qin, Appleton, WI (US); Dave Allen Soerens, Neenah, WI (US); Alison Elizabeth Vickman, Bloomington, IN (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 14/169,865

(22) Filed: Jan. 31, 2014

(65) Prior Publication Data

US 2015/0218758 A1 Aug. 6, 2015

(51) Int. Cl.

| | |
|---|---|
| ***D21H 21/22*** | (2006.01) |
| ***D21H 27/00*** | (2006.01) |
| ***D21H 27/30*** | (2006.01) |
| ***D21H 27/40*** | (2006.01) |
| ***D21H 17/00*** | (2006.01) |

(52) U.S. Cl.

CPC ..... *D21H 27/40* (2013.01); *D21H 17/74* (2013.01); *D21H 21/22* (2013.01); *D21H 27/002* (2013.01); *D21H 27/30* (2013.01)

(58) Field of Classification Search

CPC ..... D21H 21/22; D21H 27/002

See application file for complete search history.

(56) References Cited

U.S. PATENT DOCUMENTS

| | | | | |
|---|---|---|---|---|
| 2,291,080 | A | 7/1942 | Hofferbert | |
| 4,314,001 | A | 2/1982 | Wesseler | |
| 4,372,815 | A | 2/1983 | Newkirk et al. | |
| 5,935,383 | A | 8/1999 | Sun et al. | |
| 6,361,651 | B1 | 3/2002 | Sun | |
| 6,579,415 | B2 | 6/2003 | Jewell | |
| 8,980,054 | B2 * | 3/2015 | Yang et al. | 162/146 |
| 2002/0112830 | A1 | 8/2002 | Bakken et al. | |
| 2003/0051295 | A1 | 3/2003 | Soane et al. | |
| 2005/0282984 | A1 | 12/2005 | Carswell et al. | |
| 2006/0130988 | A1 * | 6/2006 | Hermans et al. | 162/123 |
| 2006/0137838 | A1 * | 6/2006 | Luo et al. | 162/9 |
| 2014/0174686 | A1 * | 6/2014 | Yang et al. | 162/202 |

FOREIGN PATENT DOCUMENTS

| | | | |
|---|---|---|---|
| EP | 0 440 472 | B1 | 8/1995 |

* cited by examiner

*Primary Examiner* — Anthony Calandra

(74) *Attorney, Agent, or Firm* — Kimberly Clark Worldwide, Inc.

(57) ABSTRACT

It has now been discovered that the sheet bulk of a tissue web may be increased, with little or no degradation in tensile strength, by forming the web with at least a portion of cellulosic fiber that has been reacted with a water soluble cellulose reactive agent such as a cyanuric halide or a vinyl sulfone and then reacting the fiber with monochloroacetic acid, or salts thereof, in the presence of a caustic.

5 Claims, No Drawings

TISSUE HAVING REDUCED HYDROGEN BONDING

BACKGROUND

In the manufacture of paper products, such as facial tissue, bath tissue, paper towels, dinner napkins, and the like, a wide variety of product properties are imparted to the final product through the use of chemical additives applied in the wet end of the tissue making process. Two of the most important attributes imparted to tissue through the use of wet end chemical additives are strength and softness. Specifically for softness, a chemical debonding agent is normally used. Such debonding agents are typically quaternary ammonium compounds containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and slough in the product. Indeed, while softness increases, it is at the expense of an increase in lint and slough in the tissue relative to an untreated control. It can also be shown that in a blended (non-layered) sheet the level of lint and slough is inversely proportional to the tensile strength of the sheet. Lint and slough can generally be defined as the tendency of the fibers in the paper web to be rubbed from the web when handled.

It is also broadly known in the art to use a multi-layered tissue structure to enhance the softness of the tissue sheet. In this embodiment, a thin layer of strong softwood fibers is used in the center layer to provide the necessary tensile strength for the product. The outer layers of such structures are composed of the shorter hardwood fibers, which may or may not contain a chemical debonder. A disadvantage to using layered structures is that while softness is increased the mechanism for such increase is believed to be due to an increase in the surface nap of the debonded, shorter fibers. As a consequence, such structures, while showing enhanced softness, do so with a trade-off in the level of lint and slough.

It is also broadly known in the art to concurrently add a chemical strength agent in the wet-end to counteract the negative effects of the debonding agents. In a blended sheet, the addition of such agents reduces lint and slough levels. However, such reduction is done at the expense of surface feel and overall softness and becomes primarily a function of sheet tensile strength. In a layered sheet, strength chemicals are added preferentially to the center layer. While this perhaps helps to give a sheet with an improved surface feel at a given tensile strength, such structures actually exhibit higher slough and lint at a given tensile strength, with the level of debonder in the outer layer being directly proportional to the increase in lint and slough.

There are additional disadvantages with using separate strength and softness chemical additives. Particularly relevant to lint and slough generation is the manner in which the softness additives distribute themselves upon the fibers.

Bleached Kraft fibers typically contain only about 2-3 milliequivalents of anionic carboxyl groups per 100 grams of fiber. When the cationic debonder is added to the fibers, even in a perfectly mixed system where the debonder will distribute in a true normal distribution, some portion of the fibers will be completely debonded. These fibers have very little affinity for other fibers in the web and therefore are easily lost from the surface when the web is subjected to an abrading force.

SUMMARY

It has now been demonstrated that a useful modified cellulosic fiber having a degree of substitution from about 0.02 to about 0.07 and a degree of carboxymethylation from about 0.05 to about 0.45 may be prepared by reacting cellulosic fiber with a cellulose reactive agent, such as a cyanuric halide, and a monochloroacetic acid, or salts thereof, in the presence of a caustic. The modified cellulosic fiber may be incorporated into tissue webs to improve bulk and other important tissue properties without a significant degradation of tensile strength. In particularly preferred embodiments modified cellulosic fibers of the present invention are selectively incorporated into one or more layers of a multi-layered web, and more specifically the middle layer of a three layered web, to yield a tissue product that is bulkier, softer and less stiff, but still has sufficient tensile strength to withstand use.

Accordingly, in one embodiment the present invention provides a method of preparing a modified cellulosic fiber having a nitrogen content greater than about 0.2 weight percent and a degree of carboxymethylation from about 0.05 to about 0.45 comprising the steps of reacting cellulosic fiber with a cyanuric halide having general Formula (I) in the presence of an organic solvent:

(I)

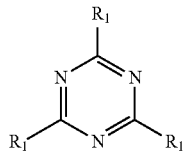

where $R_1$=chlorine, bromine, fluorine or iodine; reacting the cellulosic fiber with monochloroacetic acid, treating the cellulose fiber with a caustic agent and washing the cellulosic fiber. As described further below, the modified fiber may be prepared by performing the reactions in any sequence or simultaneously.

In other embodiments the present invention provides a method of preparing a modified cellulosic fiber having a nitrogen content greater than about 0.2 weight percent and a degree of carboxymethylation from about 0.05 to about 0.45 comprising the steps of reacting cellulosic fiber with a cyanuric halide having the general Formula (II):

(II)

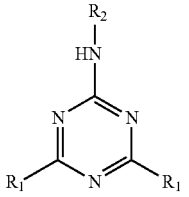

where $R_1$ equals F, Cl, Br, or I and $R_2$ equals $(CH_2)_n$—OH (n=1-3), $(CH_2)_n$—COOH (n=1-3), $C_6H_5$—COOH, or $HSO_3X$ where X equals $(CH_2)_n$ (n=1-3) or $C_6H_4$, reacting the cellulosic fiber with monochloroacetic acid, treating the cellulose fiber with a caustic agent and washing the cellulosic fiber.

In other embodiments the present invention provides a method of preparing a modified cellulosic fiber having a nitrogen content greater than about 0.2 weight percent and a degree of carboxymethylation from about 0.05 to about 0.45 comprising the steps of reacting cellulosic fiber with a cellulosic reactive reagent having the Formula (III):

(Formula III)

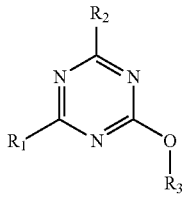

where $R_1$ and $R_2$ equal halogen, such as Cl, a quaternary ammonium group or an activated alkene and $R_3$ equals hydrogen or a metal cation, such as a sodium cation. Suitable quaternary ammonium groups include, for example, 4-m-carboxypyridinium and pyridinium. Suitable activated alkenes include, for example, alkenes having the general formula —NH—$C_6H_4$—$SO_2CH_2CH_2L$, where L is a leaving group selected from the group consisting of a halogen, —$OSO_3H$, —$SSO_3H$, —$OPO_3H$ and salts thereof. The method further comprises reacting cellulosic fiber with monochloroacetic acid, treating the cellulose fiber with a caustic agent and washing the cellulosic fiber.

In still other embodiments the present invention provides a method of preparing a modified cellulosic fiber having a sulfur content greater than about 0.2 weight percent and a degree of carboxymethylation from about 0.05 to about 0.45 comprising the steps of reacting cellulosic fiber with a vinyl sulfone having the general Formula (IV):

(IV)

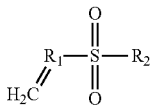

where $R_1$ equals a hydrocarbon having from about 1 to about 5 carbon atoms and $R_2$ equals $CH_3$, HC═$CH_2$, $(CH_2)_n$—$CH_3$ (n=1-3), $(CH_2)_n$—COOH (n=1-3), $C_6H_4$—COOH, or $C_6H_5$, reacting the cellulosic fiber with monochloroacetic acid or salts thereof, treating the cellulose fiber with a caustic agent and washing the cellulosic fiber.

In yet other embodiments a modified cellulosic fiber may be prepared by treating the cellulose fiber with a caustic agent and reacting the fiber with monochloroacetic acid and a water soluble cellulosic reactive compound having the general Formula (V):

(V)

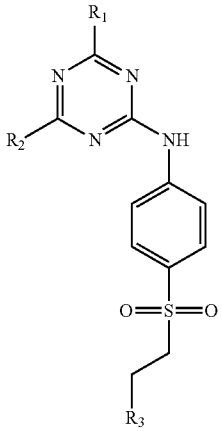

where $R_1$ equals F, Cl, Br, I or —OH, $R_2$ equals F, Cl, Br, I or —OH and $R_3$ equals —$OSO_3^-$ and salts thereof, —$SSO_3^-$ and salts thereof, phosphoric acid and salts thereof, or a halide.

In one embodiment modified fiber may then be used to form a multi-layered tissue web from the modified cellulosic fiber by selectively incorporating the modified fiber in only one layer of the multi-layered tissue web, wherein the tissue web has a basis weight greater than about 10 grams per square meter (gsm), such as from about 10 to about 50 gsm and a sheet bulk greater than about 8 cc/g and more preferably greater than about 10 cc/g, such as from about 8 to about 20 cc/g.

In other embodiments modified fibers are selectively incorporated into one or more layers of a multilayered tissue web to increase bulk and reduce stiffness without a significant reduction in tensile strength. Accordingly, in one preferred embodiment the present disclosure provides a multilayered tissue web comprising modified cellulosic fibers selectively disposed in one or more layers, wherein the tissue layer comprising modified fibers is adjacent to a layer comprising unmodified fiber and which is substantially free from unmodified fiber.

Generally the modified fibers have a rate of substitution of about 0.02 to about 0.07 and a degree of carboxymethylation from about 0.05 to about 0.45. In this manner, the disclosure provides a multi-layered tissue web having modified fiber selectively incorporated therein, where the tissue web has basis weight greater than about 10 grams per square meter (gsm), such as from about 10 to about 50 gsm, a sheet bulk greater than about 8 cc/g, such as from about 8 to about 15 cc/g and Stiffness Index less than about 15, such as from about 8 to about 12. Tissue webs prepared in this manner generally have geometric mean tensile (GMT) sufficient to maintain integrity of the web in use, such as greater than about 500 g/3" and in a particularly preferred embodiment from about 500 to about 800 g/3".

In still other embodiments the disclosure provides a multi-layered tissue web comprising a first, second and third layer, where the second layer comprises modified wood pulp fibers having a nitrogen content greater than about 0.2 weight percent and a degree of carboxymethylation from about 0.05 to about 0.45, and the first and third layers comprise unmodified conventional cellulosic fibers, where the tissue web has a basis weight from about 10 to about 50 gsm and a sheet bulk greater than about 8 cc/g. In a particularly preferred embodiment the first and third layers are substantially free of modified wood pulp fibers.

In another embodiment the present invention provides a multi-layered tissue web comprising a first, second and third layer, where the second layer comprises modified wood pulp fibers having a nitrogen content greater than about 0.2 weight percent and a degree of carboxymethylation from about 0.05 to about 0.45, and the first and third layers comprise unmodified conventional cellulosic fibers, where the tissue web has a basis weight from about 10 to about 50 gsm and a sheet bulk greater than about 8 cc/g. In a particularly preferred embodiment the first and third layers are substantially free of modified wood pulp fibers.

In still other embodiments the present invention provides a multi-layered tissue web comprising a first, second and third layer, where the second layer comprises modified wood pulp fibers having a sulfur content greater than about 0.5 weight percent and a degree of carboxymethylation from about 0.05 to about 0.45, and the first and third layers comprise unmodified conventional cellulosic fibers, where the tissue web has a basis weight from about 10 to about 50 gsm and a sheet bulk greater than about 8 cc/g.

Other features and aspects of the present invention are discussed in greater detail below.

DEFINITIONS

As used herein the terms "modified fiber" refer to any cellulosic fibrous material that has been reacted with a cellulosic reactive reagent selected from a group consisting of reagents having the general Formula (I), (II), (III), (IV) and (V) and has a degree of carboxymethylation from about 0.05 to about 0.45.

As used herein, the term "tissue product" refers to products made from tissue webs and includes, bath tissues, facial tissues, paper towels, industrial wipers, foodservice wipers, napkins, medical pads, and other similar products. Tissue products may comprise one, two, three or more plies.

As used herein, the terms "tissue web" and "tissue sheet" refer to a fibrous sheet material suitable for forming a tissue product.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "geometric mean tensile" (GMT) refers to the square root of the product of the machine direction tensile and the cross-machine direction tensile of the web, which are determined as described in the Test Method section.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g).

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope. GM Slop generally is expressed in units of kg/3" or g/3".

As used herein, the term "Stiffness Index" refers to the quotient of the geometric mean slope (having units of g/3") divided by the geometric mean tensile strength (having units of g/3").

As used herein the term "substantially free" refers to a layer of a tissue that has not been formed with the addition of modified fiber. Nonetheless, a layer that is substantially free of modified fiber may include de minimus amounts of modified fiber that arise from the inclusion of modified fibers in adjacent layers and do not substantially affect the softness or other physical characteristics of the tissue web.

As used herein the term "substitution rate" refers to the mols of chemical added per mol of glucose units in the cellulose. For cellulose fibers reacted with a nitrogen containing reactive agent, substitution rate may be calculated as:

$$SR = \frac{MW_{cell}}{\frac{MW_N \cdot z}{N_f} + MW_H - MW_{chem}}$$

Based upon the nitrogen fraction of the final reacted and washed pulp ($N_f$), molecular weight of a glucose unit in cellulose ($MW_{cell}$=162.1 g/mol), MW of the reactive agent bonded to the cellulose, MW of nitrogen (14.007), and MW of hydrogen (1.008). Generally the substation rate ranges from about 0.02 to 0.07.

As used herein the term "degree of carboxymethylation" refers to the number of hydroxyl groups on each glucose unit of the cellulose molecule that are carboxylated or substituted by monochloracetic acid. For cellulose the maximum degree of carboxymethylation is 3. The degree of carboxymethylation may be measured using the procedure described in the Test Methods section below.

DETAILED DESCRIPTION

The present invention provides a modified cellulosic fiber having reduced hydrogen bonding capabilities. The modified fiber formed in accordance with the present invention may be useful in the production of tissue products having improved bulk and softness. More importantly, the modified fiber is adaptable to current tissue making processes and may be incorporated into a tissue product to improve bulk and softness without an unsatisfactory reduction in tensile. The cellulosic fiber formed in accordance with the invention is modified cellulosic fiber that has been reacted with a cellulosic reactive reagent having the general Formula (I), (II), (III), (IV) or (V) such that the rate of substitution is from about 0.02 to about 0.07 and with monochloroacetic acid and salts thereof such that the degree of carboxymethylation from about 0.05 to about 0.45.

Unexpectedly the increase in bulk and decrease in stiffness is most acute when the modified fibers are selectively incorporated into a single layer of a multi-layered web, and particularly the middle layer of a three layered web. Webs produced in this manner not only display a surprising increase in bulk, but also produce webs having reduced stiffness without a significant deterioration in strength. Typically adding modified fibers to the center layer would decrease bonding and significantly decrease strength. To lessen this effect, one skilled in art would typically blend or add modified fibers to the outer layers. Here however, the most beneficial use of modified fibers is in the middle layer of a multi-layered web.

Although based upon their inability to participate in hydrogen bonding the modified fibers would not appear to be a suitable replacement for wood fibers, and particularly softwood fibers that customarily constitute a large percentage of the center layer of a multi-layered tissue web, it has now been discovered that by selectively incorporating modified fibers into a multi-layered web, even in amounts up to 100 percent by weight of the center layer, these negative effects may be minimized. Even more surprising is that modified hardwood pulp fibers may be used in the middle-layer of a multi-layered web without a deleterious effect.

Accordingly, in one embodiment the present disclosure provides a multilayered tissue web comprising modified fibers selectively disposed in one or more layers, wherein the tissue layer comprising modified fibers is adjacent to a layer comprising unmodified fiber and which is substantially free from unmodified fiber. In a particularly preferred embodiment the web comprises three layers where modified fibers are disposed in the middle layer and the first and third layers are substantially free from modified fibers. However, it should be understood that the tissue product can include any number of plies or layers and can be made from various types of pulp and modified fibers. The tissue webs may be incorporated into tissue products that may be either single or multiply, where one or more of the plies may be formed by a multi-layered tissue web having cotton selectively incorporated in one of its layers.

Regardless of the exact construction of the tissue product, at least one layer of a multi-layered tissue web incorporated into the tissue product comprises modified fibers, while at least one layer comprises unmodified conventional cellulosic fibers. Conventional cellulosic fibers may comprise wood pulp fibers formed by a variety of pulping processes, such as kraft pulp, sulfite pulp, thermomechanical pulp, etc. Further, the wood fibers may have any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood fibers include hardwood fibers, such as, but not limited to, eucalyptus, maple, birch, aspen, and the like, which can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste.

In addition to conventional cellulosic fibers the tissue web comprises modified fibers, which are selectively incorporated into one or more layers of the multi-layered tissue web to help increase softness in the resulting tissue product. In one particular embodiment, the modified fibers are modified wood pulp fibers. In one embodiment hardwood pulp fibers are modified by reacting the fibers with a cellulosic reactive reagent selected from a group consisting of reagents having the general Formula (I), (II), (III) and (IV) and subsequently reacting with monochloroacetic acid. The modified hardwood fibers are utilized in the formation of tissue products to enhance their bulk and softness. In one particular embodiment modified eucalyptus kraft pulp fibers having a nitrogen content greater than about 0.2 weight percent and a degree of carboxymethylation from about 0.05 to about 0.45 are incorporated into a multi-layered web having a first layer comprising a blend of modified and unmodified hardwood kraft fibers and a second layer comprising softwood fiber. In such embodiments the modified fiber may be added to the first layer, such that the first layer comprises greater than about 2 percent, by weight of the layer, modified fiber, such as from about 2 to about 40 percent and more preferably from about 5 to about 30 percent.

The chemical composition of the modified fiber of the invention depends, in part, on the extent of processing of the cellulosic fiber from which the modified fiber is derived. In general, the modified fiber of the invention is derived from a fiber that has been subjected to a pulping process (i.e., a pulp fiber). Pulp fibers are produced by pulping processes that seek to separate cellulose from lignin and hemicellulose leaving the cellulose in fiber form. The amount of lignin and hemicellulose remaining in a pulp fiber after pulping will depend on the nature and extent of the pulping process. Thus, in certain embodiments the invention provides a modified fiber comprising lignin, cellulose, hemicellulose and a covalently bonded cyanuric halide where the fiber has a nitrogen content greater than about 0.2 weight percent and a degree of carboxymethylation from about 0.05 to about 0.45.

Generally after reaction of the pulp with a cellulosic reactive reagent and monochloroacetic acid the pulps are washed to remove unreacted reagents. After washing, the extent of reaction between the pulp hydroxyl function groups and the water soluble reagent may be assessed by nitrogen elemental analysis in the case of a cyanuric halide reagent or sulfur elemental analysis in the case of a vinyl sulfone reagent of the modified pulp, with higher amounts of nitrogen or sulfur indicating a greater extent of reaction. Further, the extent of the reaction between the pulp fiber and monochloroacetic acid may be assessed by measuring the degree of carboxymethylation, as described in the Test Methods section below.

Accordingly, in one embodiment the present disclosure provides preparing a modified fiber by reacting cellulosic fiber with a nitrogen containing cellulosic reactive agent having the general formula (I), (II), (III), or (V) and subsequently reacting the fiber with monochloroacetic acid. The resulting modified fiber has a nitrogen content from about 0.05 to about 5 weight percent and more preferably from about 0.1 to about 3 weight percent and a degree of carboxymethylation from about 0.05 to about 0.45, and more preferably from about 0.10 to about 0.30.

In other embodiments the present disclosure provides preparing a modified fiber by reacting cellulosic fiber with a sulfur containing cellulosic reactive agent having the general formula (IV) and subsequently reacting the fiber with monochloroacetic acid. The resulting modified fiber preferably has a sulfur content from about 0.05 to about 5 weight percent and more preferably from about 0.1 to about 3 weight percent and a degree of carboxymethylation from about 0.05 to about 0.45, and more preferably from about 0.10 to about 0.30.

In one embodiment the modified fiber comprises a cellulosic fiber that has been reacted with a halogen atom attached to a polyazine ring, for example fluorine, chlorine or bromine atoms attached to a pyridazine, pyrimidine or symtriazine ring. One preferred type of cyanuric halide reagent contains an aromatic ring having two reactive halide functional groups attached thereto.

(Formula II)

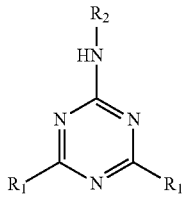

where $R_1$ equals F, Cl, Br, or I and $R_2$ equals $(CH_2)_n$—OH (n=1-3), $(CH_2)_n$—COOH (n=1-3), $C_6H_5$—COOH, or $HSO_3X$ where X equals $(CH_2)_n$ (n=1-3) or $C_6H_4$.

In a particularly preferred embodiment the water soluble cyanuric halide is a dichlorotrizines having the formula:

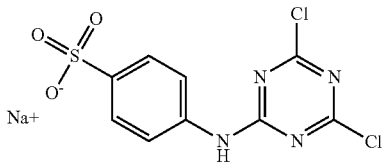

The cellulosic reactive agents may be either water insoluble or water soluble. In certain preferred embodiments the cellulosic reactive reagents are water soluble and have a water solubility of greater than about 5 mg/mL and more preferably greater than about 10 mg/mL and still more preferably greater than about 100 mg/mL, when measured at 60° C. The water solubility of the reagent provides the advantage of simplifying the modification process, reducing costs and improving reaction yields of modified fibers.

Reaction with a water soluble reagent, compared to a water insoluble reagent such as 2,4,6-trichlorotriazine, provides the additional benefit of reducing the degree of crosslinking between cellulosic fibers. For example, 2-(4,6-dichloro-(1,3,5)-triazine-2 aminoyl) ethanesulfonic acid is less reactive with cellulosic fibers than 2,4,6-trichlorotriazine because the most reactive chloride group has been substituted with amino ethane sulfonic acid to increase water solubility. The reduced reactivity and reduced number of halide functional groups results in less fiber crosslinking, which yields a modified fiber that is less stiff and more susceptible to processing, such as by refining.

In addition to being reacted one of the foregoing cellulosic reactive agents the cellulosic fiber is also reacted with monochloroacetic acid and salts thereof. Reaction with monochloroacetic acid may be carried out before, concurrent with, or after reaction with one of the foregoing cellulosic reactive agents.

Any suitable process may be used to reacted cellulosic fibers with the foregoing cellulosic reactive reagents and monochloroacetic acid. For convenience reaction of cellulosic fibers with any one of these reagents is generally referred to herein as "modification." In certain embodiments the cellulosic fiber is first reacted with a cellulosic reactive reagent and then monochloroacetic acid, followed by alkaline treatment and then washing to remove excess alkali and unreacted reagent. In addition to alkali treatment, the cellulosic fiber may also be subjected to swelling. Alkali treatment and swelling may be provided by separate agents, or the same agent.

In a particularly preferred embodiment modification is carried out by alkali treatment. Alkali treatment may be carried out before, after or coincidental to reaction with the cellulosic reactive reagent. Anionic groups are preferably generated under alkaline conditions, which in a preferred embodiment, is obtained by using sodium hydroxide. In other embodiments the alkaline agent is selected from hydroxide salts, carbonate salts and alkaline phosphate salts. In still other embodiments the alkaline agent may be selected from alkali metal or alkaline earth metal oxides or hydroxides; alkali silicates; alkali aluminates; alkali carbonates; amines, including aliphatic hydrocarbon amines, especially tertiary amines; ammonium hydroxide; tetramethyl ammonium hydroxide; lithium chloride; N-methyl morpholine N-oxide; and the like.

In addition to the generation of anionic groups by the addition of an alkaline agent, swelling agents may be added to increase access for modification. Interfibrillar and intercrystalline swelling agents are preferred, particularly swelling agents used at levels which give interfibrillar swelling, such as sodium hydroxide at an appropriately low concentration to avoid negatively affecting the rheological performance of the fiber.

Either prior to or after alkali treatment, the cellulosic fiber is reacted with a cellulosic reactive reagent. The amount of reagent will vary depending on the type of cellulosic fiber, the desired degree of modification and the desired physical properties of the tissue web formed with modified fibers. In certain embodiments the mass ratio of cellulosic fiber to reagent is from about 5:0.05 to about 2:1, more preferably from about 5:0.1 to about 4:1, such that the weight percentage of reagent, based upon the cellulosic fiber is from about 1 to about 50 percent and more preferably from about 2 to about 25 percent.

After reaction with a cellulosic reactive agent the cellulosic fiber is reacted with monochloroacetic acid. The amount of monochloroacetic acid will vary depending on the type of cellulosic fiber, the desired degree of modification and the desired physical properties of the tissue web formed with modified fibers. In certain embodiments the mass ratio of cellulosic fiber to monochloroacetic acid is from about 5:0.05 to about 2:1, more preferably from about 5:0.1 to about 4:1, such that the weight percentage of monochloroacetic acid, based upon the cellulosic fiber is from about 1 to about 50 percent and more preferably from about 2 to about 25 percent.

Further, modification may be carried out at a variety of fiber consistencies. For example, in one embodiment modification is carried out at a fiber consistency greater than about 5 percent solids, more preferably greater than about 10 percent solids, such as from about 10 to about 50 percent solids. In those embodiments where the cellulosic reactive reagent is mixed with the cellulosic fiber prior to alkali treatment it is particularly preferred that modification be carried out at a fiber consistency greater than about 10 percent, such as from about 10 to about 30 percent, so as to limit hydrolysis of the reagent.

Preferably modification of cellulosic fibers is carried out in an aqueous-alkaline solution having a pH value greater than about seven, more preferably greater than nine and more preferably greater than about ten. When the cellulosic reactive reagent is not water soluble, for example, 2,4,6-chlorotriazine, the modification reaction has to be conducted in an organic solvent. Examples of the organic solvents include, but are not limited to, acetone, methanol, ethanol, isopropanol, ethylene glycol, propylene glycol, etc. Monochloroacetic acid can be used in either a water or organic solvent system. More preferably the aqueous-alkaline solution does not include an organic solvent for benefits of lower cost and safer preparation and the cellulosic reactive reagent is not dissolved in an organic solvent prior to addition to the aqueous-alkaline solution.

The reaction time and temperature should be sufficient for the desired degree of modification. In certain embodiments modification may be carried at a temperature from about 0 about 100° C., such as from about 20 to about 70° C. In certain embodiments the treatment time at 20° C. may range from about 30 minutes to 24 hours, such as from about 30 minutes to 10 hours, and in a particularly preferred embodiment from about 40 minutes to 5 hours.

Webs that include the modified fibers can be prepared in any one of a variety of methods known in the web-forming art. In a particularly preferred embodiment modified fibers are incorporated into tissue webs formed by through-air drying and can be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

Fibrous tissue webs can generally be formed according to a variety of papermaking processes known in the art. For example, wet-pressed tissue webs may be prepared using methods known in the art and commonly referred to as couch forming, wherein two wet web layers are independently formed and thereafter combined into a unitary web. To form the first web layer, fibers are prepared in a manner well known in the papermaking arts and delivered to the first stock chest, in which the fiber is kept in an aqueous suspension. A stock pump supplies the required amount of suspension to the suction side of the fan pump. Additional dilution water also is mixed with the fiber suspension.

To form the second web layer, fibers are prepared in a manner well known in the papermaking arts and delivered to the second stock chest, in which the fiber is kept in an aqueous suspension. A stock pump supplies the required amount of suspension to the suction side of the fan pump. Additional dilution water is also mixed with the fiber suspension. The entire mixture is then pressurized and delivered to a headbox. The aqueous suspension leaves the headbox and is deposited onto an endless papermaking fabric over the suction box. The suction box is under vacuum which draws water out of the suspension, thus forming the second wet web. In this example, the stock issuing from the headbox is referred to as the "dryer side" layer as that layer will be in eventual contact with the dryer surface. In some embodiments, it may be desired for a layer containing the synthetic and pulp fiber blend to be formed as the "dryer side" layer.

After initial formation of the first and second wet web layers, the two web layers are brought together in contacting relationship (couched) while at a consistency of from about 10 to about 30 percent. Whatever consistency is selected, it is typically desired that the consistencies of the two wet webs be substantially the same. Couching is achieved by bringing the first wet web layer into contact with the second wet web layer at roll.

After the consolidated web has been transferred to the felt at the vacuum box, dewatering, drying and creping of the consolidated web is achieved in the conventional manner. More specifically, the couched web is further dewatered and transferred to a dryer (e.g., Yankee dryer) using a pressure roll, which serves to express water from the web, which is absorbed by the felt, and causes the web to adhere to the surface of the dryer.

The wet web is applied to the surface of the dryer by a press roll with an application force of, in one embodiment, about 200 pounds per square inch (psi). Following the pressing or dewatering step, the consistency of the web is typically at or above about 30 percent. Sufficient Yankee dryer steam power and hood drying capability are applied to this web to reach a final consistency of about 95 percent or greater, and particularly 97 percent or greater. The sheet or web temperature immediately preceding the creping blade, as measured, for example, by an infrared temperature sensor, is typically about 250° F. or higher. Besides using a Yankee dryer, it should also be understood that other drying methods, such as microwave or infrared heating methods, may be used in the present invention, either alone or in conjunction with a Yankee dryer.

At the Yankee dryer, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer is immediately following the creping doctor blade, permitting sufficient time for the spreading and drying of the film of fresh adhesive.

The creping composition may comprise a non-fibrous olefin polymer, as disclosed in U.S. Pat. No. 7,883,604, the contents of which are hereby incorporated by reference in a manner consistent with the present disclosure, which may be applied to the surface of the Yankee dryer as a water insoluble dispersion that modifies the surface of the tissue web with a thin, discontinuous polyolefin film. In particularly preferred embodiments the creping composition may comprise a film-forming composition and an olefin polymer comprising an interpolymer of ethylene and at least one comonomer comprising an alkene, such as 1-octene. The creping composition may also contain a dispersing agent, such as a carboxylic acid. Examples of particular dispersing agents, for instance, include fatty acids, such as oleic acid or stearic acid.

In one particular embodiment, the creping composition may contain an ethylene and octane copolymer in combination with an ethylene-acrylic acid copolymer. The ethylene-acrylic acid copolymer is not only a thermoplastic resin, but may also serve as a dispersing agent. The ethylene and octane copolymer may be present in combination with the ethylene-acrylic acid copolymer in a weight ratio of from about 1:10 to about 10:1, such as from about 2:3 to about 3:2.

The olefin polymer position may exhibit a crystallinity of less than about 50 percent, such as less than about 20 percent. The olefin polymer may also have a melt index of less than about 1000 g/10 min, such as less than about 700 g/10 min.

The olefin polymer may also have a relatively small particle size, such as from about 0.1 to about 5 microns when contained in an aqueous dispersion.

In an alternative embodiment, the creping composition may contain an ethylene-acrylic acid copolymer. The ethylene-acrylic acid copolymer may be present in the creping composition in combination with a dispersing agent.

The basis weight of tissue webs made in accordance with the present disclosure can vary depending upon the final product. For example, the process may be used to produce bath tissues, facial tissues, paper towels, and the like. In general, the basis weight of the tissue web may vary from about 5 to about 50 gsm, such as from about 10 to about 40 gsm. Tissue webs may be converted into single and multi-ply bath or facial tissue products having basis weight from about 10 to about 80 gsm and more preferably from about 20 to about 50 gsm.

In addition to having sufficient strength to withstand use and relatively low stiffness, the tissue webs and products of the present disclosure also have good bulk characteristics, regardless of the method of manufacture. For instance, conventional creped wet pressed tissue products prepared using modified fibers may have a sheet bulk greater than about 8 cc/g, such as from about 8 to about 15 cc/g and more preferably from about 10 to 12 cc/g. In other embodiments through-air dried tissue and more preferably uncreped through-air dried tissue comprising modified fibers have a sheet bulk greater than about 10 cc/g, such as from about 10 to about 25 cc/g and more preferably from about 16 to about 22 cc/g.

In certain preferred embodiments the present disclosure provides a tissue web having enhanced bulk and softness without a significant decrease in tensile, where the web has three layers—a first, a second and a third layer, wherein modified fibers are selectively disposed in the second layer and comprise from about 5 to about 50 percent, and more preferably from about 10 to about 30 percent of the weight of the web. In a particularly preferred embodiment the present disclosure provides a two-ply tissue product where each tissue ply comprises three layers and modified fibers selectively disposed in the middle layer, the tissue product having a GMT from about 600 to about 800 g/3", a sheet bulk greater than about 8 cc/g, such as from about 8 to about 12 cc/g and a Stiffness Index less than about 15, such as from about 8 to about 12.

In other embodiments the present disclosure provides a two-ply tissue product comprising an upper multi-layered tissue web and a lower multi-layered tissue web that are plied together using well-known techniques. The multi-layered webs comprise at least a first and a second layer, wherein modified fibers are selectively incorporated in only one of the layers, such that when the webs are plied together the layers containing the modified fibers are brought into contact with the user's skin in-use. For example, the two-ply tissue product may comprise a first and second tissue web, wherein the tissue webs each comprise a first and second layer. The first layer of each tissue web comprises wood fibers and modified fibers and, while the second layer of each tissue web is substantially free of modified fibers. When the tissue webs are plied together to form the tissue product the second layers of each web are arranged in a facing relationship such that the modified fibers are brought into contact with the user's skin in-use.

In other embodiments, tissue products produced according to the present disclosure have GMT greater than about 500 g/3", such as from about 500 to about 900 g/3" and more preferably from about 600 to about 750 g/3". At these strengths, the tissue products generally have GM Slopes less than about 10 kg/3", such as from about 5 to about 9 kg/3", and in particularly preferred embodiments from about 6 to about 8 kg/3". The relatively slow GM Slope and modest GMT yield products having relatively low Stiffness Index, such as less than about 15, for example from about 8 to about 15 and in particularly preferred embodiments from about 10 to about 12.

TEST METHODS

Sheet Bulk

Sheet Bulk is calculated as the quotient of the dry sheet caliper expressed in microns, divided by the bone dry basis weight, expressed in grams per square meter (gsm). The resulting Sheet Bulk is expressed in cubic centimeters per gram. More specifically, the Sheet Bulk is the representative caliper of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board." The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" with the following modifications. More specifically, samples for dry tensile strength testing were prepared by cutting a 1±0.05 inch wide strip using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 5±0.04 inches. The crosshead speed was 0.5±0.004 inches/min and the break sensitivity was set at 70 percent. The sample was placed in the jaws of the instrument, centered both vertically and horizontally. The test was then started and ended when the specimen broke. Ten representative specimens were tested for each product or sheet and the arithmetic average of all individual specimen tests was recorded as the tensile strength the product or sheet in units of grams of force per inch of sample.

Degree of Carboxymethylation

The degree of caboxymethylation was measured swelling modified fiber in 1 mL D20 (100% D) overnight. The swelled pulp is covered with 1 mL of a 50/50 mixture of D2SO4/D2O and gently agitated and heated to 95° C. for approximately 2 hours. The solutions were allowed to cool and then filtered using glass wool. The filtered liquid is retained for NMR analysis. A 500.170 MHz 1H NMR spectra was acquired using a Bruker BioSpin NMR spectrometer operating at 11.745 T. The proton spectra was obtained under quantitative conditions by using 90 pulses and sufficiently long relaxation delays (time between pulses) about 34.5 sec. The chemical shift scale was referenced using an external chemical shift reference; 0.1% H2O in D2O:H2O≡4.80 ppm.

Tissue Softness Analyzer (TSA)

Tissue softness values were measured using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 and TS750 values the blades are pressed against sample with a load of 100 mN and the rotational speed of the blades is 2 revolutions per second.

To measure softness analysis was performed in the range from 1 to 10 kHZ, with the amplitude of the peak occurring at 7 kHz being recorded as the TS7 value. The TS7 value represents the softness of sample. A lower amplitude correlates to a softer sample. TS7 values have the units dB $V^2$ rms.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the measurements are started via the PC. The PC records, processes and stores all of the data according to standard TSA protocol. The reported values are the average of five replicates, each one with a new sample.

EXAMPLES

Preparation of Modified Wood Pulp Fibers

Modified wood pulps were prepared by mixing about 100 g of eucalyptus kraft pulp and 8000 g of 3% NaOH for about 5 minutes to swell the pulp fibers. After mixing, the NaOH solution was removed by centrifugal filtration and/or mechanical pressing until the swelled pulp weight reached 300 g. Cyanuric chloride (5 g) was measured separately and dissolved in 500 ml acetone and added to the pulp. The pulp/cyanuric chloride mixture was stirred at 200 rpm at 30° C. for 2 hours. After the reaction was completed, the pulp was washed with 500 ml acetone to remove unreacted cyanuric chloride. The pulp was then washed with 500 ml water and subjected to vacuum filtration. The washed pulp was dried at 70° C. in a convection oven for 24 hours. The nitrogen content of the dried pulp was determined to be 0.70 wt %.

Twenty-five grams of the reacted pulp was then dispersed in isopropyl alcohol (see Table 1, below) and allowed to stir for 5 minutes. A solution of sodium hydroxide and water was then added to the mixture and allowed to stir for 60 minutes at 1000 rpm. Monochloroacetic acid was then added (see Table 1, below) to the mixture, which was heated to 60° C. and stirred for 3 hours. The carboxymethylated pulp was then filtered and washed twice with a 70% methanol solution and once with a 100% methanol. The pulp is then allowed to air dry overnight.

TABLE 1

| Sample | Pulp (g) | Isopropanol (g) | NaOH (g) | Water (g) | $ClCH_2COOH$ (g) | Degree of Carboxymethylation |
|---|---|---|---|---|---|---|
| 0 | 25.00 | 800.00 | 0 | 0 | 0 | 0 |
| 1 | 25.00 | 800.00 | 2.00 | 5.83 | 2.30 | 0.32 |

TABLE 1-continued

| Sample | Pulp (g) | Isopropanol (g) | NaOH (g) | Water (g) | $ClCH_2COOH$ (g) | Degree of Carboxymethylation |
|---|---|---|---|---|---|---|
| 2 | 25.00 | 800.00 | 2.50 | 7.29 | 2.88 | 0.37 |
| 3 | 25.00 | 800.00 | 3.33 | 9.72 | 3.83 | 0.45 |
| 4 | 25.00 | 800.00 | 5.00 | 14.59 | 5.75 | 0.46 |

Control pulps were also created by simply dispersing untreated pulp in isopropyl alcohol and allowed to stir for 5 minutes. A solution of NaOH and water was then added and mixed for 60 minutes followed by the addition of monochloroacetic acid, as set forth in the table below, and mixing for an additional 3 hours. The pulp was then washed twice with 70% methanol solution and once with 100% methanol and then allowed to air dry overnight.

TABLE 2

| Sample | Pulp (g) | Isopropanol (g) | NaOH (g) | Water (g) | $ClCH_2COOH$ (g) | Degree of Carboxymethylation |
|---|---|---|---|---|---|---|
| Control 1 | 25 | 800 | 0 | 0 | 0 | 0 |
| Control 2 | 25 | 800 | 2.00 | 5.83 | 2.30 | 0.14 |
| Control 3 | 25 | 800 | 2.50 | 7.29 | 2.88 | 0.26 |
| Control 4 | 25 | 800 | 3.33 | 9.72 | 3.83 | 0.31 |
| Control 5 | 25 | 800 | 5.00 | 14.59 | 5.75 | 0.28 |
| Control 6 | 25 | 800 | 10.0 | 29.18 | 11.5 | 0.70 |

Crosslinking Modified Pulps

Pulps reacted with cyanuric chloride and monochloroacetic acid, prepared as described above, were subjected to crosslinking by reaction with N-(3-dimethylaminopropyl)-N'-ethylcarbodiimide (EDC) and Adipic Dihydrazide (ADH). The cros slinking reaction was occurred during wet laying handsheet forming process. Addition of this type of chemistry was hypothesized to produce a cross-linking effect and further strengthen the web structure of the treated cellulose fiber. Mechanistically, the molecule N-(3-Dimethylaminopropyl)-N'-ethylcarbodiimide (EDC) is used to form ester bonds between the carboxymethyl and hydroxyl groups without participating in the interfiber bond itself. EDC is then converted into a stable urea derivative and released as a non-toxic byproduct. This molecule is then coupled with Adipic Acid Dihydrazide (ADH) which replaces the ester bonds with amide bonds and acts as a spacer between fibers to increase the likelihood of interfiber cross-linking. This reaction was carried out in a water slurry during the handsheet forming step under alkaline conditions where the EDC and ADH are first absorbed into the treated cellulose fiber (Sample 2) due to electrostatic interaction. An acidic environment was then established to catalyze the reaction, which usually occurs upon dilution during the handsheet making process when the pH reaches a level below 7.

TABLE 3

| Sample | Pulp (g) | Degree of Carboxymethylation | EDC (mL) | ADH (mL) |
|---|---|---|---|---|
| 5 | 25 | 0.37 | 8.41 | 6.53 |

Addition of Strength Agents to Modified Pulps

Two commercial strength agents were tested to compare the strengthening capability. Strength agent was added to the modified pulp fiber (Sample 2) slurry immediately prior to forming handsheets. The strength agents were Kymene 920A (commercially available from Ashland Inc., Wilmington Del.) and polyethyleneimine (unbranched 7500 MW). The strength agents were added at varying add-on levels: polyethyleneimine (0.50, 0.75, 1.00 and 2.00 wt % based on dry weight of modified fiber) and Kymene 920A (1.00 wt % based on dry weight of modified fiber).

TABLE 4

| Sample | Pulp (g) | Degree of Carboxy-methylation | Kymene 920A (wt %) | Poly-ethyleneimine (wt %) |
|---|---|---|---|---|
| 6 | 25 | 0.37 | — | 0.50 |
| 7 | 25 | 0.37 | — | 0.75 |
| 8 | 25 | 0.37 | — | 1.0 |
| 9 | 25 | 0.37 | — | 2.0 |
| 10 | 25 | 0.37 | 1.00 | — |

Handsheets Comprising Modified Wood Pulp Fibers

Handsheets were prepared using a Valley Ironwork lab handsheet former measuring 85×8.5 inches. The pulp (either treated or control) was mixed with distilled water to form slurries at a ratio of 25 g pulp (on dry basis) to 2 L of water. The pulp/water mixture was subjected to disintegration using an L&W disintegrator Type 965583 for 5 minutes at a speed of 2975±25 RPM. After disintegration the mixture was further diluted by adding 4 L of water. Handsheets having a basis weight of 60 gsm were formed using the wet laying handsheet former. Handsheets were couched off the screen, placed in the press with blotter sheets, and pressed at a pressure of 75 pounds per square inch for one minute, dried over a steam dryer for two minutes, and finally dried in an oven. The handsheets were cut to 7.5 inches square and subject to testing. The results of the testing are summarized below.

TABLE 5

| Sample | Tensile (gf) | Wet Tensile (gf) | Bulk (cc/g) | TS7 |
|---|---|---|---|---|
| Control 1 | 2650.4 | 106.8 | 0.177 | 1.31 |
| Control 2 | 7043.1 | — | 0.186 | 1.01 |
| Control 3 | 11004.8 | 258.4 | 0.16 | 0.74 |
| Control 4 | 12756.1 | — | 0.161 | 0.86 |
| Control 5 | 11267.4 | — | 0.177 | 1.06 |
| 0 | 105.2 | 36.2 | 0.527 | 22.14 |
| 1 | 150.3 | 16.3 | 0.554 | 22.36 |
| 2 | 444.0 | 13.9 | 0.488 | 12.69 |
| 3 | 902.3 | — | 0.41 | 7.10 |
| 4 | 2192.9 | — | 0.313 | 6.06 |
| 5 | 891.0 | 7.6 | 0.323 | 7.24 |
| 6 | 589.7 | — | 0.400 | 10.74 |
| 7 | 339.2 | — | 0.476 | 14.01 |
| 8 | 764.2 | 5.9 | 0.355 | 8.85 |
| 9 | 1417.7 | 14.3 | 0.350 | 5.66 |
| 10 | 203.4 | 17.8 | 0.523 | 17.17 |

We claim:

1. A tissue product comprising at least one multi-layered tissue web having two outer fibrous layers and a middle fibrous layer disposed between the two outer fibrous layers, the two outer fibrous layers comprising unmodified cellulosic fibers and the middle fibrous layer comprising modified hardwood kraft pulp fibers having a nitrogen content from about 0.2 to about 3.0 weight percent and a degree of carboxymethylation from about 0.05 to about 0.45, wherein the modified hardwood kraft pulp fibers comprise at least about 5 percent of the total weight of the multi-layered web and the first and third layers are substantially free from modified hardwood kraft pulp fibers, the tissue product having a basis weight from about 10 to about 50 grams per square meter (gsm), a sheet bulk greater than about 10 cc/g and a Stiffness Index from about 8 to about 12.

2. The tissue product of claim 1 wherein the modified cellulosic fibers comprise cellulosic fibers reacted with a cellulosic reactive reagent selected from the group consisting of reagents having the general formulas (I), (II), (III) and (V).

3. The tissue product of claim 1 wherein the modified fibers comprise from about 10 to about 50 percent of the total weight of the multi-layered web.

4. The tissue product of claim 1 wherein at least one multi-layered tissue web is a through-air dried tissue web and the tissue product has a sheet bulk from about 16 to about 22 cc/g, a GM Slope from about 5 to about 9 kg/3" and a GMT from about 500 to about 900 g/3".

5. The tissue product of claim 1 wherein at least one multi-layered tissue web is a creped, wet pressed tissue web and the tissue product has a sheet bulk from about 8 to about 12 cc/g and a GMT from about 600 to about 800 g/3".

* * * * *